United States Patent [19]

Mugnolo et al.

[11] Patent Number: 4,995,652

[45] Date of Patent: Feb. 26, 1991

[54] DOOR LATCH

[75] Inventors: Frank A. Mugnolo, 10616 Newbury, Westchester, Ill. 60153; Anthony Mugnolo; Joseph A. Calabrese, both of Westchester, Ill.

[73] Assignee: Frank A. Mugnolo, Westchester, Ill.

[21] Appl. No.: 395,748

[22] Filed: Aug. 18, 1989

Related U.S. Application Data

[63] Continuation of Ser. No. 20,567, Mar. 2, 1987, Pat. No. 4,880,262.

[51] Int. Cl.[5] ..... E05C 3/14

[52] U.S. Cl. ..... 292/202; 292/DIG. 53

[58] Field of Search ..... 70/DIG. 62, 379, 451; 292/202, 195, 67, DIG. 62, DIG. 53, 204, 194, 58, 63, 57

[56] References Cited

U.S. PATENT DOCUMENTS

| | | | |
|---|---|---|---|
| 473,354 | 4/1892 | Scheibel | 292/202 |
| 640,750 | 1/1900 | Converse | 292/241 |
| 1,538,965 | 5/1925 | Allen et al. | 292/60 |
| 1,604,330 | 10/1926 | Witkowski | 292/194 X |
| 1,662,907 | 3/1928 | Shilling et al. | 292/52 |
| 1,810,856 | 6/1931 | Schnell | 292/202 |
| 1,822,278 | 9/1931 | Ellingson | 70/380 X |
| 1,832,108 | 11/1931 | Falk | 70/380 X |
| 1,993,659 | 3/1935 | Goodman et al. | 292/202 X |
| 2,255,402 | 9/1941 | Vile | 70/380 X |
| 2,385,350 | 9/1945 | Dady | 292/239 |
| 2,502,539 | 4/1950 | Tinnerman | 292/202 |
| 2,515,507 | 7/1950 | Glitsch | 292/195 |
| 2,580,882 | 1/1952 | Blohm | 70/DIG. 62 X |
| 2,744,406 | 5/1956 | Labrie | 70/96 |
| 3,799,594 | 3/1974 | Watermann | 292/213 |
| 3,876,237 | 4/1975 | Hayes, Jr. et al. | 292/202 |
| 3,936,673 | 2/1976 | Kelly et al. | 70/379 R |
| 3,951,444 | 4/1976 | Shull | 292/359 |
| 4,105,230 | 8/1978 | Amann et al. | 292/202 |
| 4,153,284 | 5/1979 | Wright | 292/202 |
| 4,186,952 | 2/1980 | Glass | 292/202 |
| 4,270,780 | 6/1981 | Bernard | 292/202 |
| 4,337,972 | 7/1982 | Gill | 292/267 |
| 4,358,943 | 11/1982 | Ouellet | 70/358 |
| 4,381,656 | 5/1983 | Hayakawa | 70/451 |
| 4,398,405 | 8/1983 | Patriquin | 70/375 X |

FOREIGN PATENT DOCUMENTS

| | | | |
|---|---|---|---|
| 3701 | of 1889 | United Kingdom | 292/202 |

OTHER PUBLICATIONS

Exhibit A Sketch of EPA, dismantled and assembled.
Exhibit B-six sheets: Photocopies of parts, dismantled and assembled.
Exhibit C showing: (1) Sketch of "EPA", (2) 200% enlarged end view of lock showing stop flats.

*Primary Examiner*—Richard E. Moore
*Attorney, Agent, or Firm*—Myers & Assoc., Ltd.

[57] ABSTRACT

A latch is disclosed which is both rugged and economical. The latch includes a flanged housing which acts as a bushing for a journal portion of an operator. The operator includes a narrowed and recessed handle portion. At the inner end of the operator, a generally planar striker is placed to the interior of a door to interact with the frame. The striker rotates with respect to the housing and is limited in rotation by a stop which interacts with the housing. The striker is secured to the operator by connector means to prevent relative movement between them. The housing is fixed to the door by securement means which draws the flange of the housing against the exterior of the door.

6 Claims, 2 Drawing Sheets

100
102
104
106
108
110
112
114
116
118
124
126
128
130
132
134
136
137
138
140
142
144
146
148
150
156
168
170
172
174
176

20
22
24
26
28
30
32
34
36
38
40
42
44
46
48
50
52
54
56
58
60
62
64

4
4
104
106
106
114
116
120
122
126
128
154
156
164
165
168
170

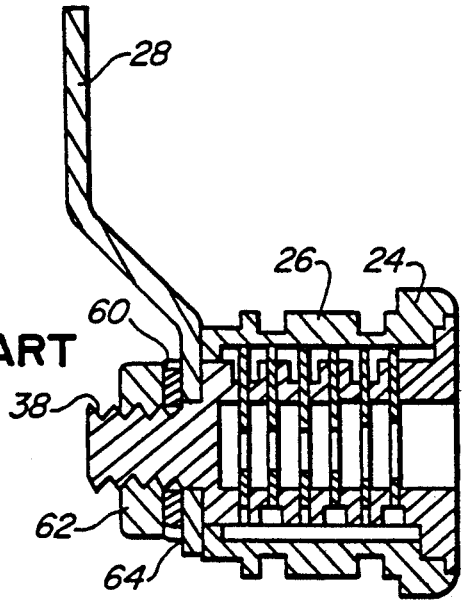
FIG. 5
PRIOR ART
FIG. 4
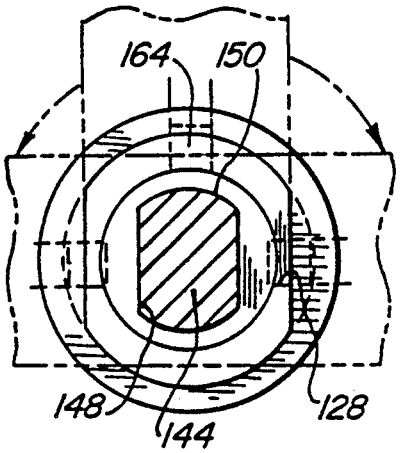
FIG. 6
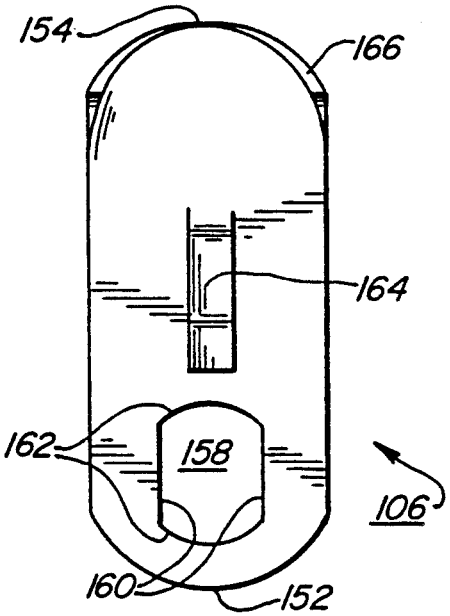
FIG. 7
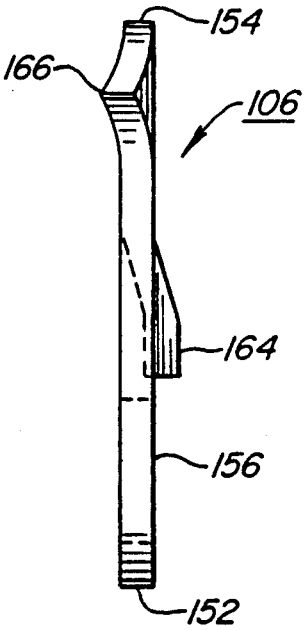
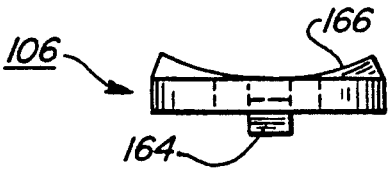
FIG. 8

DOOR LATCH

This is a continuation of co-pending application Ser. No. 07/020,567 filed on Mar. 2, 1987, now U.S. Pat. No. 4,880,262, issued Nov. 14, 1989.

BACKGROUND OF THE INVENTION

This invention relates to the field of door securement devices. More particularly, the present invention relates to door latches particularly suitable for employment with locker doors.

Lockers are purchased by a number of businesses to store employee supplies of various types, uniforms, and employee clothing. Very often, the lockers include a cylinder lock of relatively inexpensive construction. Examples of a typical lock are included in the drawing to this application in FIGS. 2 and 4. Although some manufacturers allegedly try and promote the security of lockers having this type of cylinder lock, the lockers are not in fact very secure and both the employer and employees typically avoid placing anything of value in the locker. Unfortunately, the cylinder locks are prone to malfunction and frequently prevent entry into the locker space. Additionally, employees will lose or forget to carry their key preventing easy entry. When the key is missing, if a master key is not available, the lock will have to be forced and then replaced. Similarly, when a lock malfunctions it will have to be replaced. The replacement generally causes considerable additional inconvenience and expense far in excess of the intrinsic value of the replacement lock.

FIG. 2 illustrates a typical cylinder lock 20 in an exploded view. Lock 20 includes five major components: key 22, cylinder 24, housing 26, bolt 28 and connector means 30. Cylinder 24 includes a plurality of tumblers 32, rotation stop 34, square 36 and thread 38. Cylinder 24 is received within housing interior surface 40.

Housing interior surface 40 includes at least one longitudinal tumbler groove 42 and housing stops 44. If key 22 is not inserted into cylinder 24, tumblers 32 protrude into tumbler grooves 42 to prevent relative rotation between cylinder 24 and housing 26. If a key is inserted into cylinder 24, tumblers 32 are withdrawn into the body of cylinder 24 to allow relative rotation with housing 26. However, this rotation is limited by the interaction between rotation stop 34 and housing stops 44 located at the front or exterior of housing 26. At least one housing flat 46 is provided to interface with corresponding flat on a door orifice to prevent relative rotation between housing 26 and the door. Additionally, at least one housing groove 48 is provided for receiving a tension clip to prevent longitudinal movement of housing 26 with respect to the door by restraining it between the tension clip and housing flange 50. Frequently, both the housing 26 and the cylinder 24 are fabricated from economical cast metal. Bolt 28 defines square orifice 52 in its exterior plane 54 and interfaces with a door frame at its interior plane 56. These exterior 54 and interior 56 planes are joined by offset portion 58. Bolt 28 is fitted over square 36 of cylinder 24 and fastened to cylinder 24 by connector means 30 consisting of star washer 60 and nut 62. Bolt 26, on its exterior plane 54, is brought to bear against the flat interior end 64 of housing 26.

Other locking devices for fastening doors to their frame are described in issued patents.

U.S. Pat. No. 3,876,237 to Hayes, Jr. et al. describes a LOCKING DEVICE incorporating tumbler lock 31 in handle portion 24. Crank assembly 21 consists of crank 21', a journal housing 23 and handle 24. The crank 21' is a metal rod with two 90 degree bends which allows one of the arms 25 to be journaled through the housing 23 and the other arm 26 to releasably engage receiver 22.

U.S. Pat. No. 4,270,780 to Bernard describes a DOOR FASTENER which may incorporate a standard shaft, a lock cylinder or a shaft having a head of a particular shape. A flanged bearing 2 is made longitudinally fast to a door with the aid of nut 13. A handle 14 includes pin 71 which is selectively received by bearing 2 in a position to allow relative rotation or prevent relative rotation. In FIG. 6, an embodiment is shown which includes lateral stop 67 moving in angular cutaway 69 formed at the end 68 of the bearing 2.

U.S. Pat. No. 4,186,952 to Glass describes a TURN BUTTON LATCH. The latch assembly 10 includes latch member 14 which cooperates with housing 16. Housing 16 in turn cooperates with retainer clip 18. Cylinder 60 is received within housing 16. Plate 62 including detent member 64 is placed between thumb latch 58 and cylinder 60 to cooperate with recesses 34–37. Bolt 20 is fastened to cylinder 60 through cooperation of arms 66 and 68 and pin 78. The embodiments of FIG. 12 include a locking cylinder.

Other fasteners described in patents dispense with locks.

U.S. Pat. No. 4,153,284 to Wright describes a PAWL LATCH. The Wright latch includes bush 1 and integral transverse channel shape extension 4. In head 2 an arrow shaped recess 7 points in the direction of the transverse channel to indicate the orientation of the latching arm or pawl which is partly formed by channel 4 but also by metal spring clip 8. Although principally fabricated from plastics, the latch is particularly useful to ensure electrical continuity of a wiring enclosure.

U.S. Pat. No. 4,105,230 to Amann et al describes a CLOSURE FOR PIVOTABLE FLAPS, COVERS OR THE LIKE. The closure includes locking member 4 which is approximately L-shaped and fastened to shaft 5 which receives a handle 11 to the opposite side of flap 10. A spring 6 is interposed between locking member 4 and flap 10. The closure does not appear to include a bushing or housing for shaft 5.

U.S. Pat. No. 1,662,907 to Shilling et al. describes a DOOR LATCH of relatively elaborate construction. In FIG. 5, a less elaborate embodiment is illustrated which includes a block 45 which longitudinally moves in and out of engagement with bars 20.

None of the foregoing describe or suggest a simple, economical device which avoids the drawbacks associated with the cylinder locks previously employed.

SUMMARY OF THE INVENTION

According to the present invention, there is provided a latch for securing a pivoting door, which door defines a door orifice, to a door frame in a door closed position.

The latch includes a latch bushing which has the general shape of a hallow flanged body having a bushing longitudinal inner end, a bushing longitudinal outer end, a bushing interior surface; and a bushing exterior surface. The bushing has a flange adjacent the bushing outer end which has a cross-sectional area which extends beyond the cross-sectional area of the door orifice. The bushing exterior surface extends longitudinally towards the bushing inner end and defines a first longitudinal transverse groove longitudinally disposed towards the bushing inner end from the flange. At least one stop protuberance extends longitudinally towards the inner end of the bushing. The interior surface extends longitudinally between the inner end and the outer end and includes a journal defined by a smooth cylinder wall.

The latch has an operator which has the general shape of a stepped body having an operator longitudinal inner end, an operator longitudinal outer end, and an operator exterior surface partially received within said bushing. The operator includes a handle adjacent the operator longitudinal outer end which has a cross-sectional area which extends beyond the cross-section area of the interior surface at the longitudinal outer end of said bushing. The handle has a manipulatable portion adapted to be grasped by fingers. The operator also has an attachment at the operator inner end and a bearing disposed between the handle and the attachment. The attachment has a connector portion at the operator inner end and at least one latch flat disposed between the connector portion and the bearing. The bearing has a smooth cylindrical surface. The attachment cross-sectional area is less than the minimum cross-sectional area of the interior surface of the bushing. The bearing diameter is slightly less than the diameter of the journal portion of said bushing to allow relative rotation between the bearing and the journal.

The latch includes a striker, received on the operator, which is a generally elongate and flat body having a proximal end, a distal end, and a striker outer surface facing the operator longitudinal end. The striker near the proximal end defines an attachment orifice having at least one striker flat which is conformal with the latch flat of the attachment of said operator upon which said striker is disposed. A stop adjacent the attachment orifice protrudes from the striker outer surface towards the longitudinal outer end of said operator and is adapted to interfere with the stop protuberance of said bushing and limit the relative rotation between the journal portion of said bushing and the bearing of said operator. The distal end of said striker extends far enough from the attachment orifice to be brought to bear against the door frame.

The latch also has connector means adapted to interlock with the connector portion of said operator to secure said striker to said operator by preventing longitudinal movement of said striker on said operator and to bring the striker outer surface against the inner end of said bushing.

Further, the latch has securement means bearing against the door adapted to be partially received within the longitudinally transverse groove of the bushing to restrain outer movement of the bushing.

BRIEF DESCRIPTION OF THE DRAWINGS

FIG. 4 is a transverse cross-section of the latch along the line 4—4 of FIG. 3.

FIG. 5 is a longitudinal cross-sectional view of the prior art lock cylinders.

FIG. 6 is a plan view of a striker outer surface of the latch of the present invention.

FIG. 7 is a side elevation of the striker of the latch of the present invention.

FIG. 8 is a bottom end view of a proximal end of the striker of the latch of the present invention.

DETAILED DESCRIPTION OF THE DRAWING

Figure 1:
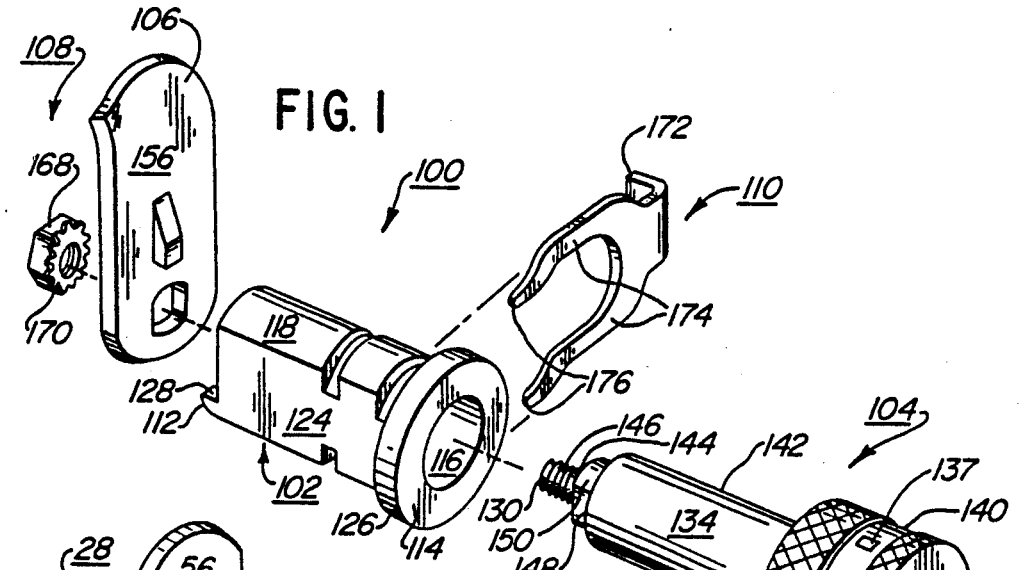
FIG. 1 illustrates an exploded view of the latch of the present invention.
Figure 2:
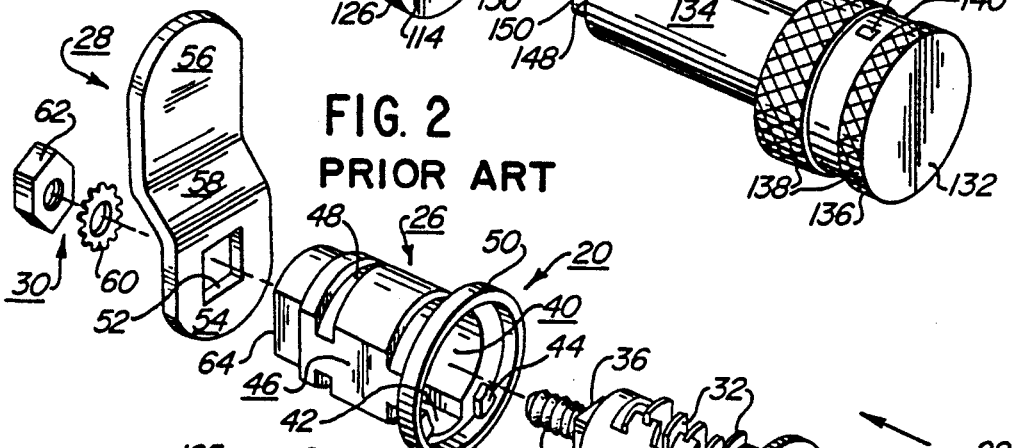
FIG. 2 PRIOR ART
FIG. 2 illustrates the prior art lock cylinders in exploded view.

The latch 100 of the present invention is shown in exploded view in FIG. 1 of the drawing. In addition to avoiding the problems associated with the cylinder locks of the prior art, latch 100 is particularly adapted to replace the cylinder locks already installed in lockers. To ensure durability, latch 100 may be machined from metal, preferably aluminum. Alternately, latch 100 may be economically fabricated from extruded or cast plastics.

Latch 100 is employed to secure a pivoting door. It is inserted through a door orifice which preferably has a flat defined along one longitudinal edge of a cylinder. Neither door nor its orifice are illustrated in the drawing.

Latch 100 includes five major components: a latch bushing 102, an operator 104, a striker 106, connector means 108 and securement means 110.

Figure 3:
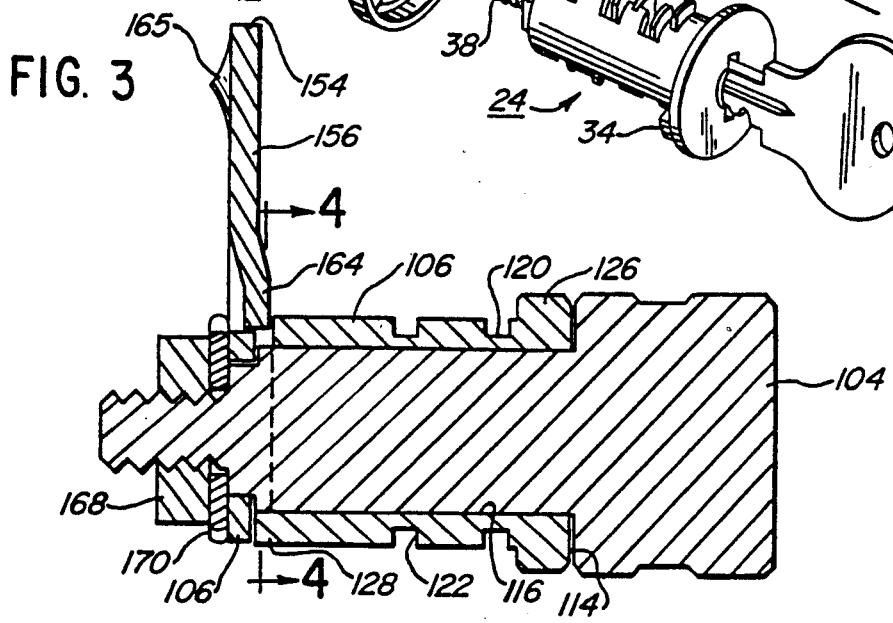
FIG. 3 is a longitudinal cross-sectional view of the latch of the present invention.

The latch bushing 102 is generally a hollow flanged cylinder having a bushing longitudinal inner end 112, a bushing longitudinal outer end 114, a bushing interior surface 116 and a bushing exterior surface 118. The bushing exterior surface 118 defines a first groove 120 and a second groove 122 in the cylindrical surface portion of bushing 102. The exterior surface further defines at least one longitudinally extending planar surface 124, and preferably two, to interface with corresponding flats of a door orifice. At the bushing longitudinally outer end 114 is a flange 126 which radially extends beyond the door orifice to prevent movement of the bushing through the orifice to the interior of a locker compartment. Near bushing interior end 112 is a stop flat or stop recess 128 which acts as a stop protuberance extending longitudinally toward the bushing longitudinal inner end 112. Stop flat 128 essentially is formed in an interrupted single plane stop protuberance substantially extending the width of latch bushing 102 as can be seen in FIGS. 3 and 4. As best seen in FIG. 3, the bushing interior surface 116 is a smooth cylinder wall extending from the bushing longitudinal outer end 114 toward the bushing longitudinal inner end 112 to act as a journal. The first groove 120 is preferably spaced inwardly from flange 126 by about 1 millimeter. The second groove 122 is preferably spaced inwardly from flange 126 about 7 millimeters.

Operator 104 is generally of the shape of a stepped cylinder having an operator longitudinal inner end 130, an operator longitudinal outer end 132 and an exterior surface 134 which is partially received within latch bushing 102. A handle 136 is located near the operator longitudinal outer end 132 and extends beyond the diameter of the bushing interior surface 116. Substantially, the entire handle presents a manipulatable portion which is adapted to be grasped by fingers. The handle 136 of operator 104 advantageously includes an indicia 137 which may be employed to visually ascertain the rotational position of latch 106. In particular, handle 136 is a cylinder including knurled portions 138, which assist rotation of the operator 104 separated by a reduced diameter portion 140, which assists axial movement of latch 100. Inwardly of the handle 136 is bearing 142 which is a smooth cylinder adapted to rotate within the journal defined by bushing interior surface 116. An attachment 144 is located outwardly from operator longitudinal inner end 130. The attachment includes a connector portion 146 which is a screw and at least one latch flat 148.

Preferably, as indicated two parallel latch flats 148 are defined and joined by two complementary semi-cylindrical surface 150.

The striker 106 is a generally elongate and flat body having a proximal end 152, a distal end 154 and an outer surface 156 which engages bushing longitudinal inner end 112. Striker 106 is shown in isolation in FIGS. 6–8. An attachment orifice 158 is defined through striker 106 near its proximal end 152. Parallel striker flats 160 joined by complementary semi-circular arcs 162 define attachment orifice 158. Distally outward from attachment orifice 158 is elongate stop 164 preferably formed from material outwardly displaced form the outer surface 156 of the body of latch 106 along its axis. At the distal end 154 of latch 106 a complex curve 166 is formed to act as a cam against a door frame. When striker 106 is received on attachment 144 and fastened thereto by connector means 108, outer surface 156 is brought to bear against bushing longitudinally inner end 112 and stop 164 limits the rotation between operator 104 and bushing 102 by abutting stop flat 128 at the limits of rotation. The interaction between stop 164 and stop flat 128 may be readily apprehended by viewing FIG. 4.

Connector means 108 include nut 168 and cap lock washer 170.

Securement means 110 is a tension clip including a flange 172 and two arcuate prongs 174 adapted to inter fit with either first groove 120 or second groove 122. Typically, the securement means is interfitted in the first groove 120 for metal doors and in the second groove 122 for wooden doors. Distal end prong ends 176 bear against an interior door surface as does a portion of the clip near clip flange 172 to urge bushing flange 126 against the exterior door surface.

The latch 100 of the present invention is simple—and therefore reliable and economical to manufacture. From the foregoing description, it will be apparent that the latch 100 of the present invention may be modified without departing from the teaching of the invention. Also apparent is that the latch of the present invention has a number of advantages, some of which have been described and others of which are inherent. Accordingly, the scope of this invention is only to be limited as necessitated by the accompanying claims.

I claim:

1. A latch for securing a pivoting door, which door defines a door orifice, to a door frame in a door closed position comprising:

a latch bushing which has the general shape of a hollow flanged body having a bushing longitudinal inner end, a bushing longitudinal outer end, a bushing interior surface, and a bushing exterior surface, said bushing including a flange adjacent the bushing outer end which has a cross-sectional area which extends beyond the cross-sectional area of the door orifice, the bushing exterior surface extending longitudinally towards the bushing inner end defining a first longitudinally transverse groove longitudinally disposed towards the bushing inner end from the flange and a stop flat extending longitudinally towards the inner end, and the interior surface extending longitudinally between the inner end and the outer end being a journal defined by a smooth cylinder wall;

an operator which has the general shape of a stepped body having an operator longitudinal inner end, an operator longitudinal outer end, and an operator exterior surface partially received within said bushing, said operator including a handle adjacent the operator longitudinal outer end which has a cross-sectional area which extends beyond the cross-section area of the interior surface at the axial outer end of said bushing, the handle including a manipulatable portion adapted to be grasped by fingers being a cylinder which includes a knurled portion of the operator exterior surface to assist rotation of the operator and includes a reduced diameter means for assisting longitudinal movement of said latch to pivot the door, said reduced diameter means bearing an indicia on said operator exterior surface which may be viewed to determine the rotational position of the striker, said operator further including an attachment at the operator inner end and a bearing disposed between the handle and the attachment, the attachment having a connector portion at the operator inner end and at least one latch flat disposed between the connector portion and the bearing, the bearing having a smooth cylindrical surface, the attachment having a cross-sectional area which is less than the minimum cross-sectional area of the interior surface of said bushing and the bearing diameter being slightly less than the diameter of the journal portion of said bushing to allow relative rotation between the bearing and the journal;

a striker, received on said operator, which is a generally elongate and flat body having a proximal end, a distal end, and a striker outer surface of said striker facing the operator axial outer end, said striker defining near the proximal end an attachment orifice having at least one striker flat which is conformal with the latch flat of the attachment of said operator upon which said striker is disposed, a stop adjacent the attachment orifice protruding from the striker outer surface towards the longitudinal outer end of said operator adapted to interfere with said stop flat of said bushing and limit the relative rotation between the journal portion of said bushing and the bearing of said operator, the distal end of said striker extending far enough from the attachment orifice to be brought to bear against the door frame;

connector means adapted to interlock with the connector portion of said operator to secure said striker to said operator by preventing longitudinal movement of said striker on said operator and to bring the striker outer surface against the inner end of said bushing; and securement means bearing against the door adapted to be partially received within the longitudinally transverse groove of said bushing to restrain movement of said bushing in a direction towards the outer end of said bushing.

2. The latch of claim 1 wherein:

the attachment of said operator has two parallel latch flats joined by two complementary semi-cylindrical surfaces; and the attachment orifice of said striker defines two parallel striker flats joined by complementary semi-circular arcs.

3. The latch of claim 1 wherein the stop of said striker is displaced material from the body of said striker.

4. The latch of claim 1 wherein said striker has a complex curve at the distal end opening away from the outer surface to provide a cam.

5. The latch of claim 1 further including a second longitudinally transverse groove defined on the bushing exterior surface of said bushing, the second groove longitudinally disposed towards the bushing inner end from the first groove, the first groove being spaced from the flange at a distance appropriate for metal doors, and the second groove being spaced from the flange at a distance appropriate for wooden doors.

6. The latch of claim 1 wherein:

the connector portion of said operator is a screw;

said connector means is a nut with a captive lock washer; and said securement means is a tension clip including a flange and two arcuate prongs, the prongs adapted to interfit a groove of said bushing and urge the flange of said bushing towards the door.

* * * * *